US007287356B2

(12) United States Patent
Sacks et al.

(10) Patent No.: US 7,287,356 B2
(45) Date of Patent: Oct. 30, 2007

(54) TWIN TRACK WIRE LATH

(75) Inventors: Abraham Sacks, Vancouver (CA); Jeffrey L Sacks, Vancouver (CA); William Spilchen, White Rock (CA); Narcis Rugina, New Westminster (CA); Harold R. Davis, Vancouver (CA)

(73) Assignee: Sacks Industrial Corp., Vancouver British Columbia (CA)

( * ) Notice: Subject to any disclaimer, the term of this patent is extended or adjusted under 35 U.S.C. 154(b) by 356 days.

(21) Appl. No.: 10/663,419

(22) Filed: Sep. 16, 2003

(65) Prior Publication Data

US 2005/0055949 A1 Mar. 17, 2005

(51) Int. Cl.

| | |
|---|---|
| ***E04F 13/04*** | (2006.01) |
| ***E04F 15/06*** | (2006.01) |
| ***E04F 19/10*** | (2006.01) |
| ***E04B 9/00*** | (2006.01) |
| ***E04H 12/00*** | (2006.01) |
| ***E04C 2/42*** | (2006.01) |
| ***E04C 5/04*** | (2006.01) |

(52) U.S. Cl. ..... 52/343; 52/342; 52/344; 52/660; 52/663; 52/664; 52/649.1

(58) Field of Classification Search ..... 52/342, 52/343, 664, 344, 660, 663, 649.1
See application file for complete search history.

(56) References Cited

U.S. PATENT DOCUMENTS 553,306 A * 1/1896 Fordyce ..... 52/669
617,458 A 1/1899 Clancy
659,416 A * 10/1900 Perry ..... 52/669
749,714 A * 1/1904 Barnes et al. ..... 245/11
1,986,172 A * 1/1935 Wilson ..... 52/520

(Continued)

*Primary Examiner*—Richard E. Chilcot, Jr.
*Assistant Examiner*—Hunter M Dreidame
(74) *Attorney, Agent, or Firm*—George Levy

(57) ABSTRACT

A welded wire lathing material for mounting stucco plaster and the like onto a building frame. This lathing material comprises intersecting transverse and primary longitudinal strands substantially located in a first plane. It also comprises secondary longitudinal strands also substantially placed in first plane and closely spaced with, some of primary longitudinal strands, thus forming longitudinal slots located at predetermined spaced intervals extending across the lathing material. The slots are wider than the shaft, but narrower than the head, of fasteners predetermined for attaching the lath to building frames. The longitudinal and transverse strands are welded together where they intersect to form a rectangular mesh approximately located in the first plane. In addition, spacing furrs are formed in the mesh by bending the transverse strands into indentations perpendicular to, and on one side of, the first plane, at predetermined space intervals and located away from points of intersection with the longitudinal strands such that the tip of the indentations defines a second plane away from the first plane. This furring structure allows the lathing material to be kept mostly separated from a building frame when it is placed with the indentations against the building frame. This structure together with shaping and flattening of the longitudinal strands allows the lath to be easily packaged into rolls.

4 Claims, 3 Drawing Sheets

U.S. PATENT DOCUMENTS 2,565,292 A * 8/1951 Athur ..... 105/375
3,299,785 A * 1/1967 James ..... 404/4
3,342,003 A * 9/1967 Frank ..... 52/664
3,475,876 A * 11/1969 Oroschakoff ..... 52/581
3,522,668 A * 8/1970 Oroschakoff ..... 52/432
3,672,022 A * 6/1972 York ..... 428/593
3,991,536 A 11/1976 Rutherford
4,003,178 A * 1/1977 Douthwaite ..... 52/664
4,245,926 A * 1/1981 Asszonyi et al. ..... 405/150.1
4,693,048 A * 9/1987 Guetersloh ..... 52/664
5,287,673 A 2/1994 Kreikemeier
5,540,023 A * 7/1996 Jaenson ..... 52/343
6,305,432 B1 10/2001 Sacks et al.
6,820,387 B2 * 11/2004 Sacks et al. ..... 52/660
2003/0029129 A1 * 2/2003 Walters ..... 52/741.1
2004/0134158 A1 * 7/2004 Farrell et al. ..... 52/664
2005/0055949 A1 * 3/2005 Sacks et al. ..... 52/633
2005/0055953 A1 * 3/2005 Sacks et al. ..... 52/633

* cited by examiner

TWIN TRACK WIRE LATH

FIELD OF THE INVENTION

This invention relates to building technology and in particular to welded wire lath which may be used to reinforce coatings, such as stucco. Specifically, this invention relates to an improved structure for a self furred welded wire lath in order to provide superior attachment points, and the ability to package the product in rolls.

BACKGROUND

Some building construction techniques involve the application of a coating, such as stucco, to a surface. This coating is the cladding or the finish for such surfaces. In the following disclosure, the term "stucco" is used generally to apply to cementitious plasters or gypsum plasters, including stuccos as defined in applicable building codes.

When applying a coating of stucco, it is generally desirable to provide a lath on the surface. The lath provides reinforcement for the stucco and attaches the stucco to the vertical building surface.

The framing for buildings is typically constructed with wood or steel studs. In some situations, sheathing may be applied over the framing. This sheathing may be in the form of wood boards, plywood, oriented strand board (OSB), gypsum wall board, EPS foam or other types of sheathing material. In other situations, the framing is left open. Typically, a water resistant membrane, such as building paper or building wrap, is applied over the open framing or over the sheathing. The lath is then applied over the water resistant membrane.

The lath is attached to wood and metal framing by various fasteners, generally including nails, staples, self-tapping screws or other mechanical fastening means. Fastening is normally spaced every 6 inches in the vertical direction with framing 16 inches on center or every 4 inches in the vertical direction with framing 24 inches on center. With open frame structures, the lath must be attached to the frame elements. In the case of structures with sheathing, for structural purposes, it is still desirable to attach the lath to the frame elements. In these situations the fasteners must pass through the sheathing material first.

There are a number of different metal lath types being used for stucco coatings. One common type is expanded metal lath. Another group of stucco laths are wire fabric laths. Within this group there are woven wire laths and welded wire laths. This invention is specifically related to the welded wire lath group.

In the prior art, welded wire lath is provided in a variety of configurations, but it is comprised typically of a wire mesh of intersecting horizontal and vertical wires that are welded together at the intersections, defining a plurality of square or rectangular openings. Typically, mesh openings are 2 inches by 2 inches, 1½ inches by 1½ inches, or 1 inch by 1 inch.

Another requirement for stucco surfaces is that the lath be spaced away from the framing or sheathing to allow the stucco, when applied, to surround the lath and obtain sufficient keying and bonding. This spacing is achieved with the use of furring or spacing devices, such as furring nails, or with the application of self-furring laths. In the prior art as disclosed by Frank in U.S. Pat. No. 3,342,003, the mesh reinforcement has bent portions for spacing the mesh away from a substrate. However, one major disadvantage with the prior art as disclosed by Frank is that the bent portions are bent to form a 'dovetail' shape and the bent portions "are in contact with each other and rigidly secured together". This requires a separate process which is difficult and costly to incorporate into a manufacturing process.

In the past, the most common construction practice has been wood framing with the lath attached by staples. The advantage of using staples is that the two legs of a staple can surround both sides of a horizontal wire and physically trap the lath to the structure. It would not be necessary to try and attach at an intersection of the lath.

However, the use of staples is now being discouraged for several reasons. First, each staple produces two holes in the moisture barrier membrane, whereas a nail or screw only produces one hole at each location. With the increasing problems of moisture entry into structures and the resulting material deterioration and mold concerns, there is a desire to reduce the number of penetrations through the moisture barrier membrane.

Secondly, steel framing is becoming more popular as wood framing becomes more expensive. Steel framing has typically been used in non load bearing commercial or high rise applications but, more recently, it is now being used to a greater extent in load bearing residential applications. Staples cannot be used with steel framing and self-tapping screws must be substituted. The screws must have a large head and must be applied at an intersection of the horizontal and vertical wires. This method of attachment for the lath is a problem because the lath is not securely attached to the structure. In some cases, the intersection of the lath does not coincide with the framing member. Furthermore, the lath is only being pinched under a part of the screw and it is not trapped, which may cause it to disengage with structural movement.

Thirdly, it was found that staples sheared off of structures in the Northridge earthquake in California in 1993 and that stucco claddings fell off of buildings. In those cases, stucco was also providing shear value to the structure and when the stucco came loose, the buildings suffered serious damage and collapse. As a result, various jurisdictions had banned the use of staples for attaching lath in seismic zones. Further, with prior art lath, it was found that there was inadequate embedment of the lath in the stucco and, as a result, there was delamination of the lath and stucco during the Northridge earthquake in Northridge Calif.

Rutherford in U.S. Pat. No. 3,991,536 discloses an improved welded wire fabric lath, which includes double strands of wire located at predetermined spaced intervals. The wires of the double strand are spaced slightly apart to provide a slot for receiving fasteners that are used to hold the lath in place on wood and metal framing. Rutherford states "that screw fasteners or nails can now be used, thus eliminating the use of other mechanical fasteners to attach the lathing and eliminating the perforations through the waterproof backing."

In Rutherford's invention, the double strands are located at the furring location. As he clearly shows in his figures, the double strands are not in the same plane as the body of the lath. This results in two problems. First, as a result of this configuration, the lath cannot be rolled up and can only be produced in sheets. Secondly, the double strands are not furred away from the building frame and are not embedded by the stucco when it is applied.

A problem of economic importance is the method for packaging the lath; more specifically the ability of the lath to be rolled up for easy handling and shipping. Clancy in U.S. Pat. No. 617,458 and Jaenson in U.S. Pat. No. 5,540,023 describe wire mesh lathing material in which strands are welded at the furring location and therefore not in the plane of the lath. Consequently, this structure makes their laths impossible to be rolled up for any practical purposes.

Another invention described by Kreikemeier in U.S. Pat. No. 5,287,673 consists of a lath cast in plastic with furring consisting of bars. This structure makes it impossible for his lath to be rolled up in the direction of the bars.

In U.S. Pat. No. 6,305,432 Sacks describes a lath with flattened wires along one particular direction. This design which allows the lath to be rolled along that direction and therefore compactly packaged, can save significant costs in shipping and handling. Sacks' design however, does not have the slots structure as described by Rutherford.

Hence, there is a need for an improved welded stucco lath that provides positive attachment with nails or screws. The welded lath should also be manufactured in rolls, it should be self furring, and all the horizontal wires should be in the proper plane.

It is therefore an object of this invention to provide a self-furring lath equipped with slots comprising closely spaced parallel strands welded to the lath, wide enough to allow the insertion of fastener's shafts, yet narrow enough to hold the fastener's heads and to further provide a lath with these closely spaced parallel strands which are furred away from the building frame.

It is a further object of this invention to describe a lath with closely spaced parallel strands, that can be compactly rolled for easy and economical handling and shipment.

SUMMARY OF THE INVENTION

The present invention relates to an improved welded wire lathing material. The improved lathing comprises a plurality of spaced apart, parallel intersecting vertical and horizontal strands, secured together at the points of intersection such that the strands define a screen of predetermined mesh dimensions. In lathing material of this improved type, an additional strand is located adjacent to and spaced a small distance from certain horizontal strands such that pairs of closely spaced strands define a plurality of parallel slots extending across the lathing material. This lath also has a plurality of furring legs formed on the vertical strands in between a pair of horizontal strands.

The advantages of the improved lathing of the present invention relative to the prior art are significant and numerous. Because all of the longitudinal strands are in the same plane, including the spaced apart strands, the improved lathing can be packaged in rolls. This is an advantage in manufacturing, shipping and installation. Lath material that is packaged in rolls can be installed quicker which results in a time savings for installers. Furthermore, the number of vertical joints is minimized with this improved lath, which is important because joints are always a source of weak points and they can potentially develop cracks. Minimizing the vertical joints is also important because at every joint an overlapping of lath material is required, resulting in wasted material. This waste can range from a few inches up to 15-16 inches depending on where the next stud falls in relation to the sheet length.

The second major benefit of this improved lath is that all of the longitudinal strands are furred away from the structure. This provides improved keying and reinforcement of the stucco. This is important in order to minimize cracking of the stucco and to prevent disengagement of the stucco from the lath.

In one aspect of the invention, the horizontal and vertical strands could be of a generally circular profile. In a preferred embodiment of the invention, the closely spaced horizontal strands could be shaped, such as a flattened or oval profile. The benefit of such a mesh is that the surface area of the strands in contact with the vapor resistant membrane is increased, resulting in less pressure and less tendency to cut the membrane as the fastener is tightened.

In another embodiment of the invention, the closely spaced horizontal strands could be of a different size than the nominal size of the other horizontal strands. These strands could each be as little as one third of the cross-sectional area of the nominal horizontal strands. Since there are two strands in these locations and if these strands are of shaped wires, the combination of the double wires and the increase in tensile strength through cold working this lath could still provide the same strength as a conventional lath with standard horizontal wire spacing. This embodiment would provide the advantages of the double wires without an increase in the amount of material per square area and hence without added material cost.

In yet another embodiment of the invention, all of the horizontal strands could be of a shaped profile, either of similar cross-section areas or dissimilar areas.

Further features, aspects, and advantages of the present invention will be more fully understood when considered with respect to the following detailed description claims and accompanying drawings.

DETAILED DESCRIPTION OF DRAWINGS

Figure 1:
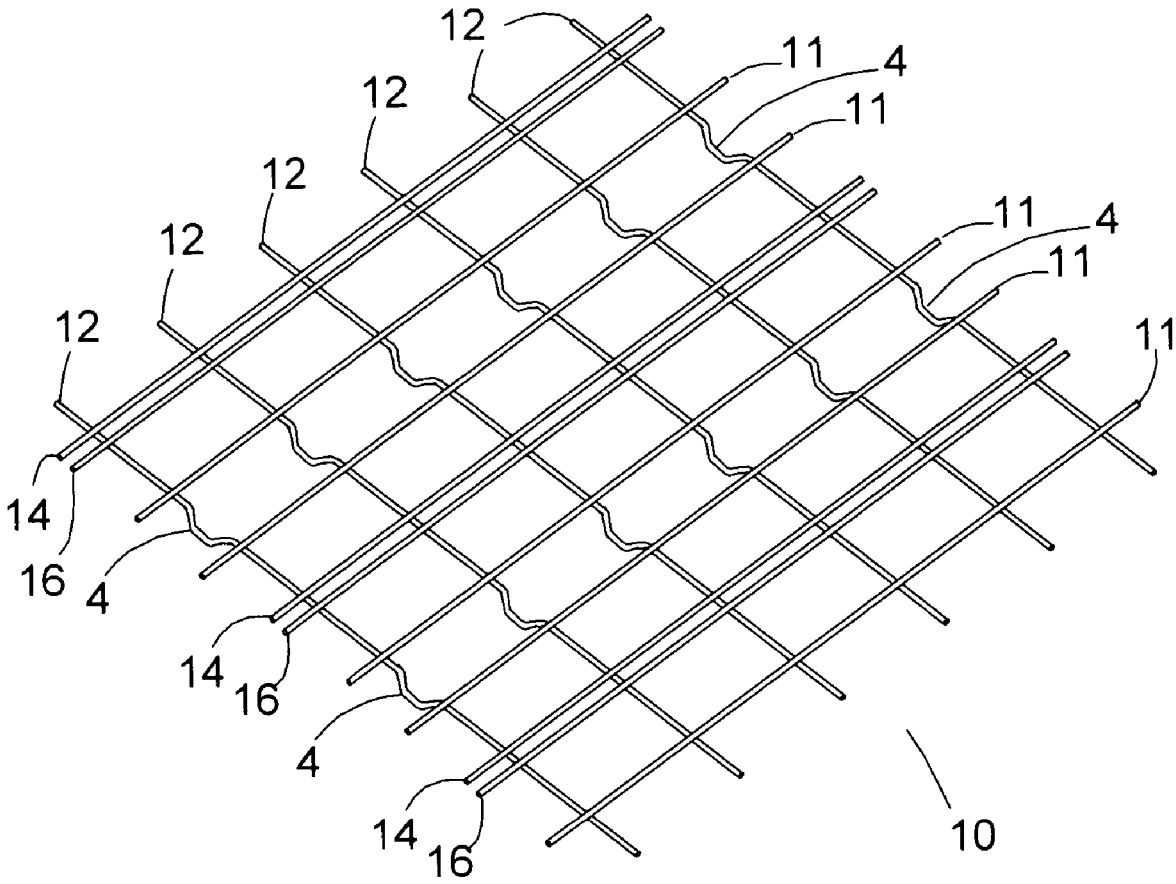
FIG. 1 is a semi-schematic view of self-furring, welded wire, lathing material provided in accordance with the invention.

A preferred embodiment of self furring welded wire lath 10 in accordance with the present invention is shown in FIG. 1. The lath 10 comprises a plurality of spaced apart horizontal strands 11 and a plurality of spaced apart vertical strands 12 which intersect at right angles with respect to each other and are spot welded at each point of intersection, comprising approximately 1½ inch by 1½ inch rectangles. At spaced intervals vertically, a pair of strands 14, 16 replace the single strands 11. Strands 14, 16 are spaced apart preferably one-eighth of an inch, to define a continuous horizontal slot extending across the length of the lathing 10 for receiving fasteners. These double closely spaced apart strands 14, 16 are positioned at intervals approximately every 4 to 6 inches vertically across the width of the lath 10.

Any one of a number of well known materials are used to fabricate welded wire lath 10, such as drawn steel, stainless steel, aluminum, copper, or the like. Seventeen gauge galvanized steel wire is preferred for strands 11, 12 and nineteen gauge for strands 14, 16.

Furring crimps 4 are fashioned at suitable intervals along the length of the vertical wires 12 by a crimping or stamping mechanism (not shown). Sufficient pressure is applied to portions of the vertical strands 12 at spaced apart intervals to form approximately V-shaped indentations. In the preferred embodiment, these furring crimps 4 would have a flat bottom shaped indentation. The flat portions of the furr 4 provide firm support with a relatively large area to reduce the tendency of the furrs to penetrate or dig into the supporting surface. The supporting surface is normally covered with a vapor resistant membrane and it is important not to penetrate or damage this membrane.

Furring crimps 4 are provided along the vertical strands 12 at intervals corresponding to approximately every second or third vertical grid space. The furring crimps are ¼ inch in depth, which is intended to space the bulk of the wire lath 10, a ¼ of an inch away from the framing material.

The furring crimps 4 are positioned between horizontal strands 11. As a result, this construction of the wire lath 10 enables the horizontal strands 11 and the closely spaced strands 14, 16 to remain in the same plane. This has two significant advantages. First, all of the horizontal strands 11 and closely spaced strands 14, 16 are in the same plane. When this wire lath 10 is applied to a wall surface, all of these strands 11, 14, 16 will be evenly positioned ¼ inch away from the framing material and stucco plaster when applied will be able to completely surround and embed around all of the strands 11, 14, 16. This is very important to achieve full keying and embedment of the wire lath 10, which results in an improved wall with less cracking, superior shear strength for seismic events, and that will not delaminate off the stucco.

The second advantage of this preferred embodiment of all horizontal strands 11, 14, 16 being positioned in the same plane is to allow the self furred lath 10 to be easily rolled lengthwise into a roll. The strands 11, 14, 16 are flexible and since they are in the same plane, the lath 10 can be rolled tightly into a roll without distorting or damaging the wire lath 10. The furring crimps 4 pass into spaces between the crossed strands so as not to contact or interfere with other strands in such a way as to hinder the rolling of the fabric. As a result, the wire lath can be packaged in rolls of approximately 150 feet length. This is an advantage in shipping and packaging. It is also an advantage in installation in that it reduces the number of vertical joints which results in faster installation, less cracking caused by joints, and reduced wastage of material at overlaps.

Figure 2:
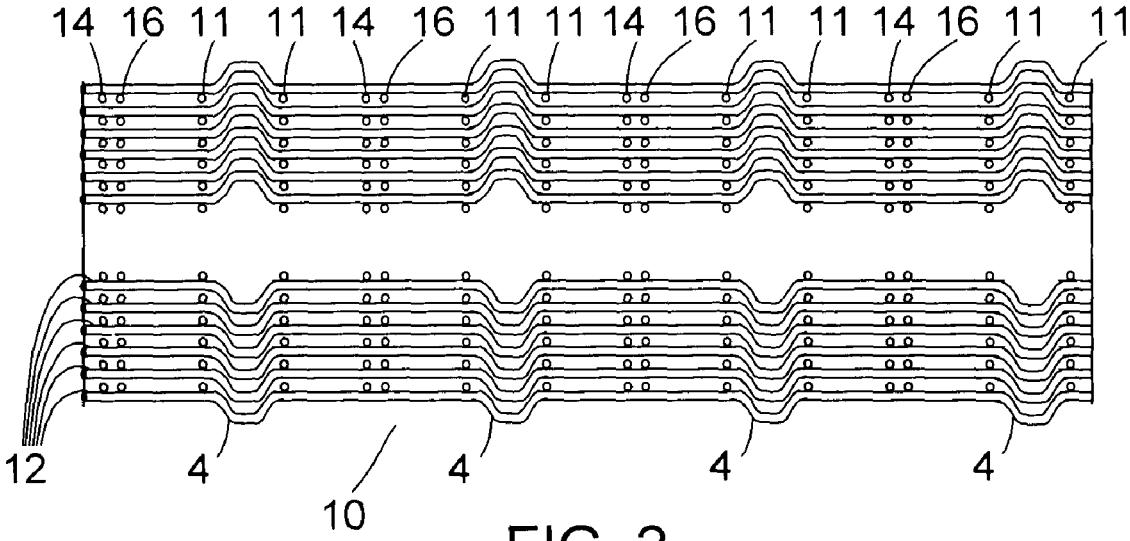
FIG. 2 is a cross-section of a partial roll of the lathing material in accordance with the invention showing each revolution nesting with the previous revolution.

FIG. 2 shows a cross-sectional view of the improved lathing material 10 in accordance with the invention in a partial roll. The lathing material 10 can be wound in the roll either with furrs 4 facing outwards or inwards. The preferred method is with furrs 4 facing outwards as shown in FIG. 2. The roll is made more compact because of nesting of the indentation when their walls are 45 degrees or less from the plane of the lath. In other words, the indentations must be in the shape of wide and open u's or v's to allow compact nesting. The advantages that this improved lath 10 packaged in this method are many compared to prior art lath such as that disclosed by Rutherford. First as shown in FIG. 2, the roll of lathing is very compact and dense. The regular longitudinal strands 11 and closely spaced longitudinal strands 14, 16 overlay the same strand in the previous revolution, separated by a series of transverse strands 12. There is no space or gap between the series of longitudinal strands 11, 14, 16 and the transverse strands 12.

Further, the rows of furrs 4 on the transverse strands 12 coincide linearly with furrs 4 from the previous revolution. The majority of the furrs 4 will be staggered from the furr 4 directly below in the previous revolution and will not interfere. However, approximately 7% of the furrs 4 will overlay totally or partially a furr 4 in the previous revolution. In the preferred embodiment, the angles of the side walls of furrs 4 are between approximately 20 and 50 degrees and preferably at 45 degrees or less, from the plane of the lath 10. This ensures that the furrs 4 are self stacking and that there is no interference with furrs 4 on each revolution regardless of where they align in relation to underlying furrs 4.

Therefore, this improved lath 10 can be packaged very densely, which is an advantage for warehousing, shipping and material handling. This advantage reduces shipping costs and packaging costs, and reduces potential to damage of the lath 10 during material handling.

With the furrs 4 facing outwards, the roll of lathing with closely spaced strands can be placed against a wall surface during application. The leading edge can be attached with staples, nails or the like, at locations between longitudinal strands 14 and 16. The lathing 10 can be unrolled for considerable distance of some 80 to 100 feet, or more if required, without joints or overlaps. The lath 10 can then be pulled tight, attached at the opposite end, and remainder of the roll cut off. The installer can then attach the lath 10 at each framing member in accordance with building codes and specifications.

Therefore, there are additional advantages for the installer at the job site in relation to the prior art. The dense rolls are much easier to handle and move on ladders and scaffolds. The improved lathing 10 in rolls with furrs facing outwards eliminates double handling of the lath, and increases productivity of the installer. The dense package enables a single installer to conveniently and safely apply lath to large areas without overlaps and joints. This reduces material waste, reduces potential for cracks at joints, and overall reduces labor and material costs.

Figure 3:
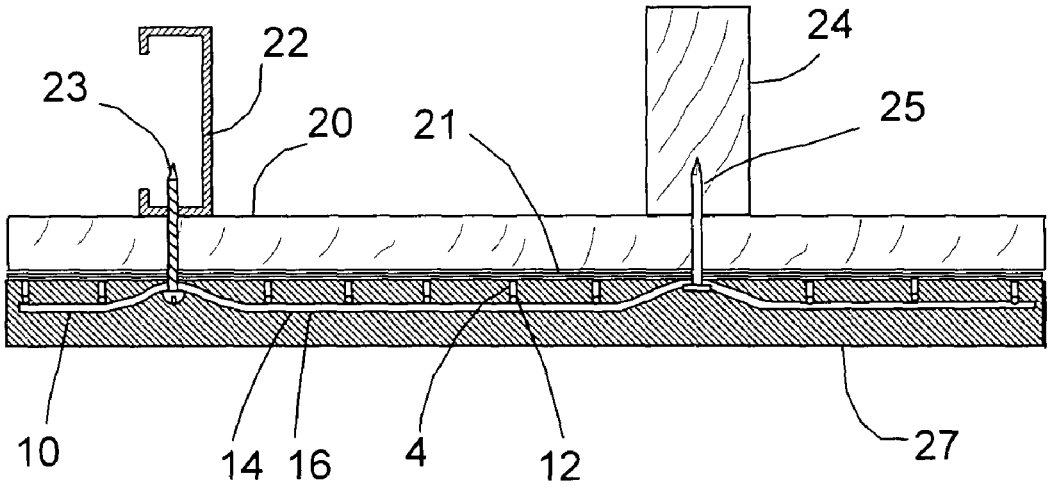
FIG. 3 is a plan view of a horizontal cross-section of the lathing material in accordance with the invention after installation on sheathing and framing.

FIG. 3 shows a cross section in plan view of lathing material 10 in accordance with the invention, attached over sheathing to framing and with plaster or stucco or the like applied to the attached lathing. In one example, steel stud framing 22 is shown and in another, wood stud framing 24 is shown. This improved lath 10 could also be applied to other structural materials such as solid concrete, brick, concrete block or other. Sheathing material 20, which can include plywood, oriented strand board (OSB), gypsum board, cement board. EPS foam or other, is attached to the framing. A vapor resistant membrane 21 such as asphalt paper is applied over the sheathing.

The improved wire lath 10 is then applied and attached either to the framing elements 22, 24 or in some cases to the sheathing 20. In the case of steel framing, self tapping screws 23 may be used for attaching the lath, and in the case of wood framing, nails 25 may be used for attaching the lath. In each case, the fasteners are applied between each pair of closely spaced longitudinal strands 14, 16. Stucco plaster 27 is then applied, usually in two coats, first coat being a scratch coat and the second being the brown coat. A finish coat is usually applied, or sometimes the stucco is painted. The stucco can be applied by hand trowel or by hose from a pump.

As can be seen in FIG. 3, the closely spaced longitudinal strands 14, 16 are held a consistent distance away from the vapor resistant membrane 21, except only for the area directly at the fasteners 23, 25. The other longitudinal strands 11 are also positioned in this same plane.

This is a significant improvement and advantage over the prior art. As can be seen in FIG. 3, stucco plaster 27, can surround and embed the closely spaced longitudinal strands 14, 16 as well as the other longitudinal strands 11. This feature provides improved keying and reinforcement and results in a stronger, improved stucco cladding.

Figure 4:
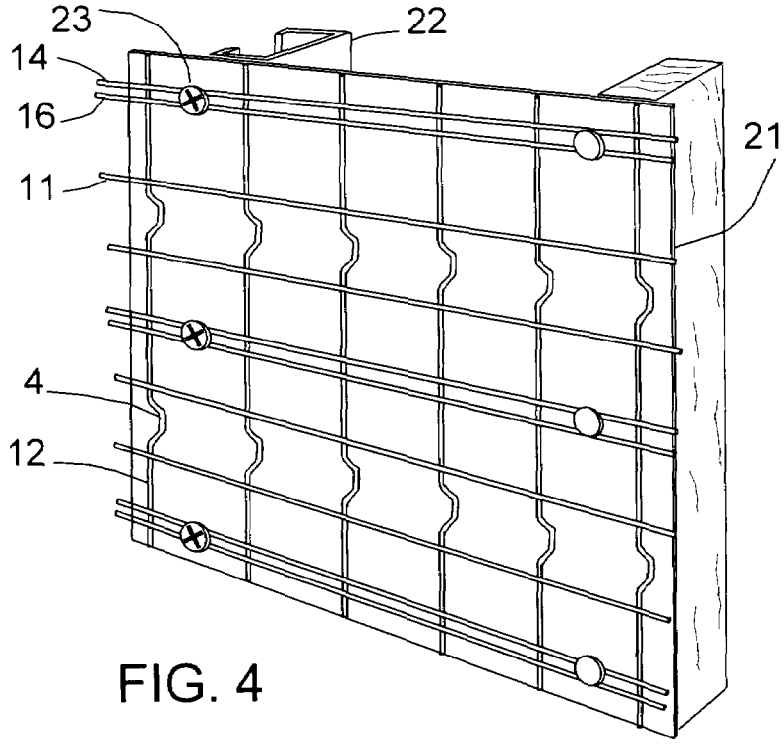
FIG. 4 is a semi-schematic front elevation of the lathing material in accordance with the invention when installed on framing.

As shown in partial front elevation FIG. 4, the lath 10 as described in FIG. 1 is attached to a typical wall construction. Building paper 21 is applied over steel studs 22 and then lath 10 is applied. Screws 23 are inserted between closely spaced longitudinal strands 14, 16 attaching the lath 10 to the steel framing 22. Screws 23 or other fasteners are applied approximately every 6 inches along the steel studs 22. As can be seen in FIG. 4, the fasteners need not coincide or engage the vertical strands 12 to achieve a full strength attachment. The furrs or crimps 4 create a space between the building paper 21 and the body of the lath 10. This space is critical for the wet stucco plaster to surround the horizontal strands 11, 14, 16 and the vertical strands 12, to achieve proper embedment around the lath 10.

Figure 5:
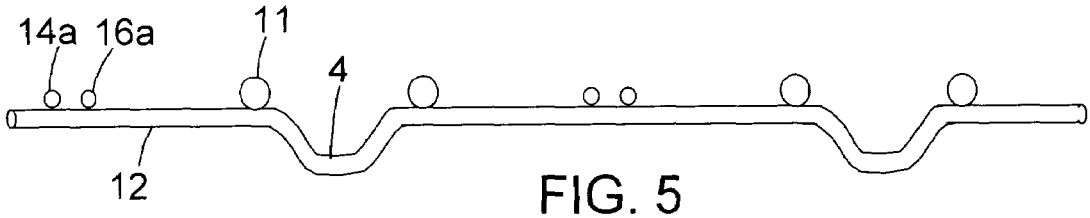
FIG. 5 is a side cross-section of the longitudinal strands of the lathing material in accordance with the invention with closely spaced strands of a smaller circular area than nominal horizontal strands.

FIG. 5 shows a partial cross section of another embodiment of the invention wherein the longitudinal strands 11 are of a generally round cross section, and the closely spaced longitudinal strands 14*a*16*a* are of a smaller generally round cross section. The cross section area of 14*a*16*a* could range from approximately one third to one half that of longitudinal strands 11. The cross section of vertical strand 12 is a generally round cross section, similar in area to horizontal strands 11.

Figure 6:
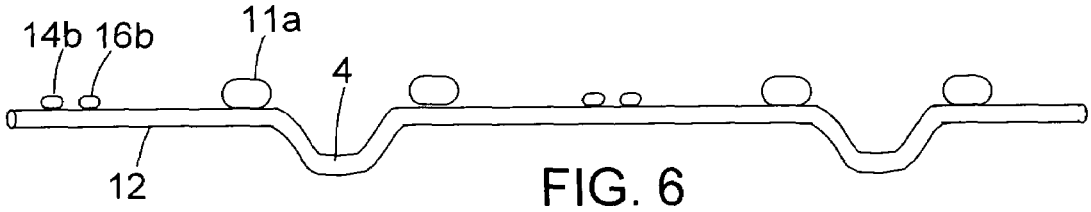
FIG. 6 is a side cross-section of the longitudinal strands of the lathing material in accordance with the invention with horizontal strands of a flattened profile.

FIG. 6 shows a partial cross section of the preferred embodiment of the invention. Horizontal strands 11*a* are a flattened cross section with an area approximately equivalent to 17½ gauge (0.051 inch diameter) round wire. Closely spaced horizontal strands 14*b*, 16*b* are also a flattened cross section but each of a smaller cross section. The sizes of these strands 14*b*, 16*b* in the preferred embodiment would have an area approximately equivalent to 19 gauge (0.040 inch diameter). The cross section of vertical strand 12 would be generally round with a size of 17½ gauge (0.051 inch diameter). The locations of the closely spaced longitudinal strands 14*b*, 16*b* would be spaced either 4 inches or 6 inches apart. The furring crimps 4 would be spaced either 3 inches, 4 inches or 6 inches apart on each vertical strand 12.

For example the lathing material may include vertical (i.e., transverse) strands having cross-sections from 0.032 inches to 0.063 inches in diameter and grid spacing from 1 inch to 2 inches.

In another example the lathing material may include vertical (i.e., transverse) and horizontal (i.e., longitudinal) strands having nominal cross section from 0.0475 inches to 0.054 inches and grid spacing from 1.4 inches to 1.6 inches.

In yet another example the lathing material may include strands forming pairs of horizontal (i.e., longitudinal) strands ranging from 0.035 inches to 0.055 inches in nominal cross section.

In yet a further example, the horizontal (i.e., longitudinal) strands may have a flattened cross-section profile equivalent to a circular cross section of 0.035 inches to 0.055 inches and the strands forming pairs of horizontal (i.e. longitudinal) strands may have a flattened cross-section profile with a minor axis ranging from 0.015 inches to 0.025 inches and a major axis ranging from 0.050 inches to 0.070 inches.

The terms "horizontal" and "vertical" have been used above to indicate in a simple fashion the mutually perpendicular relationship of the intersecting strands. This nomenclature, however, is not meant to restrict how the lath can be oriented with respect to a building frame. To express this concept, a more general nomenclature can be adopted, in which the term "horizontal" is replaced by "longitudinal" and the term "vertical," by "transverse." Consequently, and in accordance with this new nomenclature, the lath as described in the above embodiments is most likely to be applied with its longitudinal direction along the horizontal axis.

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

What is claimed is:

1. A welded wire lathing material packaged into a roll and for use in mounting stucco plaster and the like onto a building frame, comprising, a) a plurality of spaced-apart, approximately parallel transverse strands substantially located in a first plane;

b) a plurality of spaced apart, approximately parallel primary longitudinal strands also substantially located in said first plane, intersecting and in contact with said transverse strands;

c) a plurality of secondary longitudinal strands also substantially placed in said first plane and closely spaced and approximately parallel with, some of said primary longitudinal strands, thus forming pairs of longitudinal strands, said pairs defining a plurality of longitudinal slots located at predetermined spaced intervals extending across said lathing material, said slots being wider than the shaft, but narrower than the head, of fasteners predetermined for attaching said lath to said building frame;

d) said plurality of transverse strands welded to said primary strands and to said secondary strands at their points of intersections, and forming a rectangular mesh approximately located in said first plane;

e) a plurality of spacing furrs formed by bending said transverse strands into indentations perpendicular to, and on one side of, said first plane, at predetermined space intervals extending across said lathing material, and located along said transverse strands, each said spacing furr situated between two of said primary longitudinal strands or between one of said primary longitudinal strands and one of said secondary strands, the tip of said indentations defining a second plane away from said first plane.

2. A lathing material as in claim 1 wherein longitudinal strands have a shaped cross-section profile.

3. A lathing material as in claim 2 wherein said longitudinal strands have a flattened cross-section profile.

4. A method of fabricating a building wall using welded wire lath material adapted to be wound in rolls, for applying stucco on a building frame, comprising the steps of a) arranging in a transverse direction a plurality of spaced-apart, approximately parallel transverse strands substantially located in a first plane;

b) arranging in a longitudinal direction, a plurality of spaced-apart approximately parallel primary longitudinal strands also substantially located in said first plane, intersecting and in contact with said transverse strands;

c) arranging in a longitudinal direction a plurality of secondary longitudinal strands also substantially placed in said first plane and closely spaced and approximately parallel with, some of said primary longitudinal strands, thus forming pairs of longitudinal strands, said pairs defining a plurality of longitudinal slots located at predetermined spaced intervals extending across said lathing material, said slots wide enough to allow the shaft of fasteners to penetrate said slots, but narrower than the head of said fasteners, said fasteners predetermined for attaching said lath to said building frame;

d) welding said transverse strands to said primary strands and to said secondary strands at their points of intersections, said plurality of strands forming a rectangular mesh located in a first plane; and e) forming a plurality of spacing furrs by bending said transverse strands into indentations perpendicular to, and on one side of, said first plane, at predetermined space intervals extending across said lathing material, each said spacing furr situated between two of said primary longitudinal strands or between one of said primary longitudinal strands and one of said secondary strands, the tip of said indentations defining a second plane away from said first plane, thus allowing said lathing material to be kept mostly separated from said building frame when it is placed with said indentations against said building frame.

* * * * *